US006610399B1

(12) United States Patent
Crigler

(10) Patent No.: US 6,610,399 B1
(45) Date of Patent: Aug. 26, 2003

(54) MULTI-LAYER, THERMAL PROTECTION AND CORROSION PROTECTION COATING SYSTEM FOR METALLIC TENDONS, ESPECIALLY FOR EXTERNAL POST-TENSIONING SYSTEMS

(75) Inventor: John R. Crigler, Woodbine, MD (US)

(73) Assignee: Structural Technologies, LLC, Hanover, MD (US)

( * ) Notice: Subject to any disclaimer, the term of this patent is extended or adjusted under 35 U.S.C. 154(b) by 158 days.

(21) Appl. No.: 09/715,791

(22) Filed: Nov. 17, 2000

(51) Int. Cl.[7] ..... F16L 11/00; F16L 9/14

(52) U.S. Cl. ..... 428/375; 428/364; 428/365; 428/378; 428/920; 138/124; 138/149; 138/153; 52/740.1

(58) Field of Search ..... 428/364, 365, 428/375, 378, 920, 34.6, 34.7, 35.7, 36.1, 36.2, 36.9, 36.91, 376, 377; 14/22; 138/124, 149, 153; 52/740.1

(56) References Cited

U.S. PATENT DOCUMENTS

| | | | |
|---|---|---|---|
| 3,913,290 | A | 10/1975 | Billing et al. |
| 4,069,075 | A | 1/1978 | Billing et al. |
| 4,292,358 | A | 9/1981 | Fryer et al. |
| 4,835,054 | A | 5/1989 | Scarpa |
| 4,929,650 | A | 5/1990 | Kurauchi et al. |
| 5,208,077 | A | 5/1993 | Proctor et al. |
| 5,254,190 | A | 10/1993 | Kurauchi et al. |
| 5,433,991 | A | 7/1995 | Boyd, Jr. et al. |
| 5,487,946 | A | 1/1996 | McGinniss et al. |
| 5,580,648 | A | 12/1996 | Castle et al. |
| 5,603,990 | A | 2/1997 | McGinniss et al. |
| 5,681,640 | A | 10/1997 | Kiser |
| 5,985,385 | A | 11/1999 | Gottfried |
| 6,074,714 | A | 6/2000 | Gottfried |

OTHER PUBLICATIONS

Richard G. Gewain, "Fire Experience and Fire Tests in Automobile Parking Structures," Firt Journal, p. 50–54, (Jul. 1973).

*Primary Examiner*—Cheryl A. Juska
*Assistant Examiner*—Lynda Salvatore
(74) *Attorney, Agent, or Firm*—Jenkens, Wilson & Taylor, P.A.

(57) ABSTRACT

A thermally protected and corrosion protected structure, that has in combination a core substrate and a concentric composite laminate, wherein: (i) the core substrate has a length and extends at least substantially within and is surrounded by the laminate; and (ii) the laminate has a plurality of concentric layers. The concentric layers include: (a) an inner layer of a corrosion protective material substantially along and surrounding the length of the core substrate; (b) a layer of a first protective plastic coating surrounding the corrosion protective material; (c) a layer of a heat-resistive intumescent coating surrounding the first protective plastic coating; (d) a layer of a reinforcing mesh embedded in or on the intumescent coating; and (e) an outer layer of a second protective plastic coating.

17 Claims, 1 Drawing Sheet

MULTI-LAYER, THERMAL PROTECTION AND CORROSION PROTECTION COATING SYSTEM FOR METALLIC TENDONS, ESPECIALLY FOR EXTERNAL POST-TENSIONING SYSTEMS

TECHNICAL FIELD

The present invention relates, in general, to novel thermally protected and corrosion protected structures. More particularly, the present invention relates to such structures that comprise in combination a core substrate and a concentric laminate, especially where the core substrate comprises a metallic tendon, and even more especially a tendon used in an external post-tensioning system.

BACKGROUND OF THE INVENTION

Structural systems and methods can utilize internal or external post-tensioning tendons which are typically metallic and can comprise strands, wires and/or bars. Tendons can consist of either single or multiple metallic elements and can be used, for example, in concrete construction, steel construction, and timber construction as well known to those of skill in the art. External tendons do not have the benefit of being surrounded by concrete or other protection, and therefore are much more susceptible to corrosion and damage from heat in the event of a fire.

In the past, it has been common for an external tendon to be protected by providing duct to surround the tendon, and then injecting suitable grout into the duct. This method functions well to protect an external tendon, but this method also is quite an expensive process.

It is thus quite desirable to provide an efficient and cost-effective structure and method by which to protect such external tendons. It is also desirable to provide an efficient and cost-effective structure and method for protecting from corrosion and heat any core substrate such as, for example, metallic data lines, electrical power lines or other suitable materials.

Of interest to the present invention, U.S. Pat. No. 6,074,714 to Gottfried discloses a fire and heat protection wrap that includes a concentric composite laminate structure having a plurality of concentric layers for the protection of structural steel components (columns, beams and open web joints), which are exposed to high temperatures of up to 5 hours in duration. The plurality of concentric layers includes an outer first layer, an inner second layer, an inner third layer, and an inner core fourth layer. The outer first layer is a fiberglass textile having an intumescent coating resistant to heat, water, and impact. Each of the inner second layer and the inner core fourth layer is a metal foil layer for reflecting heat and eliminating the convection transfer of heat. The inner core third layer is a low conductivity refractory blanket for reducing the transmission of heat.

Also of interest, U.S. Pat. No. 5,985,385 to Gottfried discloses a fire and heat protection wrap for conduits, cable trays, other electrical transmission lines, and gas and oil pipelines. The protection wrapping system includes a concentric composite laminate structure having a plurality of concentric layers for the protection of electrical transmission lines, gas pipelines, and oil pipelines that are exposed to high temperatures in excess of 3 hours in duration. The plurality of concentric layers includes an outer first layer, an inner second layer, an inner third layer, and an inner core fourth layer. The thermal protection wrapping system is effective at continuously maintained temperatures up to 2200° F. (1215° C.) for at least 3 hours in duration.

Additionally of interest, U.S. Pat. No. 5,603,990 (continuation-in-part) and U.S. Pat. No. 5,487,946 (parent), both to McGinniss et al., disclose an intumescent coating system and method for thermally protecting a substrate having a surface exposed to a flame environment. The coating system has a first component which upon heating forms a rigid carbonific char foam having toughness and rigidity, and a second component which upon heating forms an insulative carbonific char foam having a density about half the density of the rigid carbonific foam for insulation properties. The two foam components offer flame retardancy at film thickness of less than 50 millimeters.

Furthermore of interest, U.S. Pat. No. 5,433,991 to Boyd, Jr. et al. discloses a reinforcement system for mastic intumescent fire protection coatings that is a hybrid mesh fabric made from a combination of high temperature and low temperature yarns. The mesh is expandable and stretchable.

Also of interest, U.S. Pat. No. 3,913,290 to Billing et al. discloses a wire mesh and fireproof coating to provide a fire insulation reinforcement for structural members. During fires the coating may lose bonding properties and sections may fall from the member, thus exposing the bare member to the fire. The wire mesh holds the coating in place even though it has lost its bonding effect.

The following U.S. patents are of general background interest. U.S. Pat. No. 5,580,648 to Castle and Gaffney discloses a reinforcement system for mastic intumescent fire protective coatings. Free-floating carbon mesh is embedded in the coatings for reinforcement. U.S. Pat. Nos. 3,913,290 and 4,069,075, both to Billing and Castle, describe the use of mesh to reinforce the char once it forms in a fire. U.S. Pat. No. 5,681,640 to Kiser discloses a passive fire protection system for the protection of conduits, cable trays, support rods, and structural steel against flame and heat in a severe, total-environment type fire. The system includes a multi-layered (laminated), flexible material containing a plurality of layers of intumescent materials, configured to provide containment for the carbonaceous foam resulting from the expansion of the intumescent materials. U.S. Pat. Nos. 4,929,650 and 5,254,190, both to Kurauchi et al., disclose a coating material for tendons for pre-stressed concrete. The material is coated on the tendon surface used in post-tensioning pre-stressed concrete systems in order to protect the tendon from rust and corrosion, and to integrate the tendons with the concrete.

U.S. Pat. No. 4,292,358 to Fryer et al. discloses a heat resistant barrier having one or more layers, each being a support medium in the form of a plurality of closely spaced strands coated with a heat actuated and resistive intumescent coating. The support medium preferably is an expanded metal mesh. U.S. Pat. No. 5,208,077 to Proctor et al. discloses a method for making a composite material of a coated and filled metal strand for use in pre-stressed concrete, stay cables for cable-stayed bridges, and other uses. Internal voids or interstices are filled with epoxy-based resin such that any corrosive media that might penetrate the epoxy coating will be prohibited from migrating through the voids or interstices between and along the cables. U.S. Pat. No. 4,064,359 to Peterson et al. discloses a fire protective insulating product which, when placed about electrical cables, cable trays, or conduits, protects the cable or the like from exposure to open flame temperature of 1600–2000° F. (871–1093° C.). The inner layer of the protective product is preferably glass fibers in the form of a flexible blanket of approximately one-half to about one inch (1.27 to 2.54 cm) thick. On the glass layer is a fire protective coating, such as a water-based coating. The outer layer also includes a compound that is a source of organically bound halogen to help impart flame retarding. U.S. Pat. No. 4,835,054 to Scarpa discloses a protective covering for electrical cables. The covering has a thermally intumescent coating supported on an open network of metal fibers.

All of the patents and published patent applications mentioned above are incorporated by reference herein.

Despite the prior art as referenced above, there still remains a continuing need to develop protection systems which provide effective thermal protection and corrosion protection to metallic tendons.

DISCLOSURE OF THE INVENTION

Accordingly, the present invention provides a thermally protected and corrosion protected structure particularly suitable for metallic tendons, comprising in combination a core substrate and concentric composite laminate, wherein: (i) the core substrate has a length and extends at least substantially within and is surrounded by the laminate; and (ii) the laminate has a plurality of concentric layers. The concentric layers include: (a) an inner layer of a corrosion protective material substantially along and surrounding the length of the core substrate; (b) a next layer of a first protective plastic coating surrounding the corrosion protective material; (c) a next layer of a heat-resistive intumescent coating surrounding the first protective plastic coating; (d) a reinforcing mesh surrounding and being either on or embedded in the intumescent coating; and (e) an outer later of a second protective plastic coating surrounding the above components.

Consequently, it is an object of the present invention to provide a system that affords both thermal protection and corrosion protection for a core substrate, particularly a substrate that is a tendon for use in post-tensioning systems.

Some of the objects of the invention having been stated above, other objects will become evident as the description proceeds, when taken in connection with the accompanying drawing and laboratory example as best described below.

DETAILED DESCRIPTION OF THE INVENTION

Figure 1:
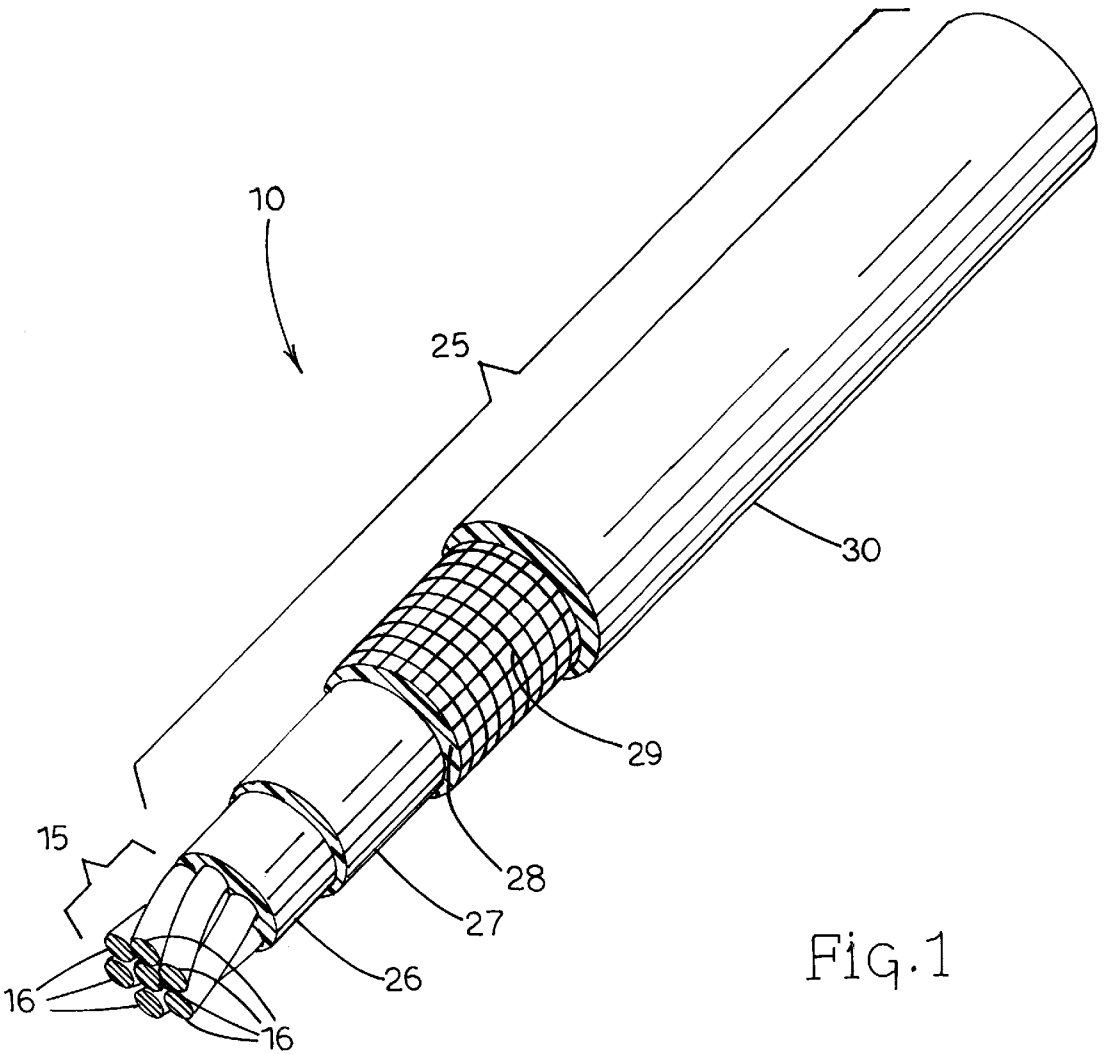
FIG. 1 is a perspective view of a preferred embodiment of the thermally protected and corrosion-protected structure of the present invention, showing (1) a core substrate that is a 7 wire strand tendon and (2) a concentric composite laminate that has 5 layers.

With reference now to FIG. 1, shown is a perspective view of a preferred embodiment of the thermally protected and corrosion protected structure generally designated 10 of the present invention. More particularly, illustrated is core substrate 15 surrounded by concentric composite laminate 25.

Core substrate 15 preferably comprises at least one structural component. In a preferred embodiment, the structural component comprises at least one tendon. As discussed previously and as known to those skilled in the art, tendons are typically metal (steel) and can comprise one or more metallic strands, one or more metallic wires, and/or one or more metallic bars. Core substrate 15 is the tendon and is illustrated in a preferred embodiment as a 7-strand metal tendon, where six wires 16 are wrapped or twirled around one center wire 16. It is envisioned in accordance with the present invention of course that core substrate 15 could be any suitable tendon and could comprise one or more metallic wires and/or one or more metallic bars in addition to or in lieu of wires 16.

In accordance with this invention, core substrate 15 particularly is suited as a tendon for use in an external post-tensioning system. External post-tensioning systems are well known and described in several of the above-mentioned U.S. patents. Due to their external exposure, such systems have encountered problems with corrosion from rain, humidity, and winter road salt as well as problems with easy exposure to fire hazards.

Concentric laminate 25 is illustrated in a preferred embodiment with five layers 26, 27, 28, 29, and 30.

First layer 26 serves as an inner layer of a corrosion protective material that is substantially along and surrounding the length of core substrate 15. First or inner layer 26 of a corrosion protective material preferably can be selected from the group consisting of grease and wax, although it is envisioned according to the present invention that the corrosion protective material could be any other suitable material.

Second layer 27 serves as a first protective plastic coating that surrounds and protects corrosion protective inner layer 26. Second layer 27 of protective plastic coating preferably comprises a flexible thermoplastic film of a polyolefin. The polyolefin may be selected from the group consisting of ethylene vinyl acetate copolymer, ethylene methyl acrylate copolymer, ethylene butyl acrylate copolymer, ethylene ethyl acrylate copolymer, polypropylene, very low density linear polyethylene, linear low density polyethylene, low density polyethylene, medium density polyethylene, high density polyethylene, and combinations thereof. Layer 27 may be a mono-layer film or a multi-layer. film, as is well known in the art of flexible polyolefin films, and, as is described below, should be applied by the well known plastic extrusion method to form a tight fit around the outside of first layer 26. Second layer 27 preferably has a thickness from about 20 mils to about 30 mils, more preferably about 25 mils. Second layer 27 serves to keep in place inner layer 26, which is preferably grease or wax that surrounds core substrate 15, although it is envisioned that other suitable corrosion protective materials could be utilized in accordance with this invention.

In accordance with this invention, it is envisioned that a single layer of material could be used in place of first layer 26 and second layer 27. Such a single layer of material could serve both the role of providing corrosion protection and of providing a substantially closed, protective covering. Any suitable single layer material could be used for such a single layer.

Third layer 28 serves as a heat-resistive intumescent coating that surrounds first protective plastic layer 27. Intumescent coatings are well known and are described in several of the above-mentioned U.S. patents. As is well known, an intumescent material will, upon heating, expand and form a char or carbonaceous foam, and thus, intumescent materials are fire retardant. Broadly, such intumescent coatings comprise a polyhydric organic compound, an acid forming catalyst, and a blowing agent which intumesces the carbonific char formed from the acid-catalyzed pyrolysis of the polyhydric compound into a carbonific char foam. As is well known, when a fire occurs, the resultant carbonaceous foam that forms when the intumescent material is hot can fall off the inside material that is to be protected from the fire. It has been found in accordance with this invention that a preferable and particularly suitable intumescent coating for use as third layer 28 is PIT-CHAR™, a proprietary intumescent coating commercially available from PPG Industries, Inc. of Pittsburgh, Pa.

To avoid the problem of carbonaceous foam falling off, fourth layer 29 serves as a reinforcement, preferably a reinforcing mesh that can surround and be on the outer side of the intumescent coating which is referenced as third layer 28. For clarity purposes, the reinforcing mesh is shown as fourth layer 29 and on the outer side of third layer 28, although in the preferred embodiment, the reinforcing mesh is actually embedded within the intumescent coating shown as third layer 28 so that the intumescent coating and the reinforcing mesh can essentially be one layer. Applying an intumescent coating onto a mesh is well known and is described in several of the above-mentioned U.S. patents. Fourth layer 29 of reinforcing mesh preferably comprises a fiberglass mesh, although fourth layer 29 can be constructed of any other suitable material in accordance with this invention. The thickness of the intumescent coating referenced as third layer 28, including the reinforcing mesh referenced as fourth layer 29, can vary but typically is expected to be at least about 25 mils thick.

Fifth layer 30 serves as an outer layer of a second protective plastic coating that surrounds third layer 28 and fourth layer 29. The second protective plastic coating preferably comprises a flexible thermoplastic film of a polyolefin. The polyolefin may be selected from the group consisting of ethylene vinyl acetate copolymer, ethylene methyl acrylate copolymer, ethylene butyl acrylate copolymer, ethylene ethyl acrylate copolymer, polypropylene, very low density linear polyethylene, linear low density polyethylene, low density polyethylene, medium density polyethylene, high density polyethylene, and combinations thereof. Preferably, outer layer 30 has a thickness ranging from about 35 mils to about 45 mils, more preferably about 40 mils. Outer layer 30 may be a mono-layer film or a multi-layer film, as is well known in the art of flexible polyolefin films, and, as is described below, should be applied by the well known extrusion method to form a tight fit around the underlying structure.

Construction or assembly of the concentric composite laminate 25 around core substrate 15 can occur by suitable steps known to those of skill in the art and can utilize suitable steps as described in many of the prior art patents as referenced above. In a preferred method, there are two primary steps for construction.

In the first step, core substrate 15 is first passed through a device that applies first layer 26, which is the corrosion protective material. Core substrate 15 with first layer 26 is then passed through a plastic extruder that applies second layer 27, which is the first protective plastic coating. A water bath is used to cool this first protective coating, which causes it to shrink tightly around core substrate 15.

In the second step, core substrate 15 as processed from step one is preferably wrapped with the reinforcing mesh referenced as fourth layer 29, passed through a device that applies in liquid form the intumescent coating referenced as third layer 28, and immediately thereafter is passed through a plastic extruder that applies fifth layer 30, which is the outermost layer of plastic coating.

LABORATORY EXAMPLE

A custom fire exposure was conducted on 6 pre-stressing tendons, prepared in accordance with the preferred embodiment depicted in FIG. 1. The tendons were a nominal 74 inches (188 cm) long and included a 7-wire strand, encased in grease followed by a high density polyethylene (HDPE) inner-liner, an application of an intumescent coating over a glass-fiber mat, and an HDPE outer jacket. The outer diameter was 11/16-inch (1.75 cm).

The tendons were instrumented and exposed to two environments following custom time-temperature profiles. The goal was to evaluate the strand temperatures during the fire exposures.

The test procedure exposed tendons to a prescribed temperature profile. The test program employed 2 separate tests, 3 tendons each. The tendons were laid atop a small, horizontal furnace. The test furnace was fueled by 3 natural gas burners and contained 3 thermocouples to measure the heat generated by the burners. Tendons were placed a nominal 16 inches (40.6 cm) apart from each other and spanned the length of the furnace (unsupported length of approximately 4 feet (122 cm)).

The first test exposed 3 tendons to a temperature profile, which reached 1000° F. (538° C.) within 5 minutes, and maintained this temperature for 17 minutes (total exposure time of 22 minutes). The lid of the furnace was removed following the fire exposure and cool-down data were recorded.

Strands were instrumented with 1/16 inch (0.16 cm) sheathed, grounded junction, Type E thermocouples. This was accomplished by soldering the thermocouple to the center or king wire and positioning the king wire/thermocouple end at the center of the test tendon. This was done by pulling the king wire through the strand until the thermocouple rested at the center of the tendon.

Data on furnace and specimen temperatures were logged at 5-second intervals.

The second test exposed 3 tendons to a temperature profile, which reached 750° F. (399° C.) within 5 minutes, and maintained this temperature for 17 minutes (total exposure time of 22 minutes). The lid of the furnace was removed following the fire exposure and cool-down data were recorded.

Results of the first test indicated ignition of the outer HDPE material at 4 minutes 5 seconds, as evidenced by a rapid increase in furnace temperature as well as visual observations. The time of ignition corresponded to a furnace temperature of approximately 843° F. (451° C.). Once ignited, tendons were seen burning for the remainder of the duration of the 22-minute test.

On the other hand, for the second test, tendons did not ignite during the 22-minute exposure.

In summary with respect to both tests, char layers resulting from the intumescent coating were uniform. Tendon diameters following each test were on the order of 1.75 inches (4.45 cm), indicating a char depth of approximately ½ inch (1.27 cm). Bonding to the tendons was good, with 3 to 4 inch (7.6 to 10.2 cm) longitudinal openings in the char layer in some locations.

It will be understood that various details of the invention may be changed without departing from the scope of the invention. Furthermore, the foregoing description is for the purpose of illustration only, and not for the purpose of limitation—the invention being defined by the claims.

What is claimed is:

1. A thermally protected and corrosion protected structure, comprising in combination a core substrate and a concentric composite laminate, wherein:

(i) the core substrate has a length and extends at least substantially within and is surrounded by the laminate; and (ii) the laminate has a plurality of concentric layers including:

(a) an inner layer of a corrosion protective material substantially along and surrounding the length of the core substrate, (b) a layer of a reinforcing mesh on the layer of corrosion protective coating, (c) a layer of a heat-resistive intumescent coating surrounding the inner layer of corrosion protective material, and (d) an outermost layer of a protective plastic coating.

2. The thermally protected and corrosion protected structure according to claim 1 further comprising a layer of a second protective plastic coating surrounding the corrosion protective material and surrounded by the layers of intumescent coating and reinforcing mesh.

3. The thermally protected and corrosion protected structure according to claim 1 wherein the layer of reinforcing mesh is embedded within the layer of intumescent coating.

4. The thermally protected and corrosion protected structure according to claim 1 wherein the core substrate comprises at least one structural component.

5. The thermally protected and corrosion protected structure according to claim 4 wherein the structural component comprises at least one tendon.

6. The thermally protected and corrosion protected structure of claim 5 wherein the tendon comprises one or more metallic strands.

7. The thermally protected and corrosion protected structure according to claim 6 wherein the tendon comprises at least one metallic wire.

8. The thermally protected and corrosion protected structure according to claim 6 wherein the tendon comprises at least one metallic bar.

9. The thermally protected and corrosion protected structure according to claim 5 wherein the tendon comprises a plurality of post-tensioning metallic strands.

10. The thermally protected and corrosion protected structure according to claim 1 wherein the corrosion protective material is selected from the group consisting of grease and wax.

11. The thermally protected and corrosion protected structure according to claim 1 wherein at least one of the first protective plastic coating and the second protective plastic coating comprises a polyolefin.

12. The thermally protected and corrosion protected structure according to claim 11, wherein the polyolefin is selected from the group consisting of ethylene vinyl acetate copolymer, ethylene methyl acrylate copolymer, ethylene butyl acrylate copolymer, ethylene ethyl acrylate copolymer, polypropylene, very low density linear polyethylene, linear low density polyethylene, low density polyethylene, medium density polyethylene, high density polyethylene, and combinations thereof.

13. The thermally protected and corrosion protected structure according to claim 11 wherein the first plastic coating is polyolefin and has a thickness between approximately 20 and 30 mils.

14. The thermally protected and corrosion protected structure according to claim 11 wherein the second plastic coating is polyolefin and has a thickness between approximately 35 and 45 mils.

15. The thermally protected and corrosion protected structure according to claim 1 wherein the intumescent coating has a thickness between approximately 20 to 30 mils.

16. The thermally protected and corrosion protected structure according to claim 1 wherein the reinforcing mesh comprises a fiberglass mesh.

17. A thermally protected and corrosion protected tendon for concrete construction, comprising in combination a core substrate and a concentric composite laminate, wherein:

(i) the core substrate is metallic, has a length and extends at least substantially within and is surrounded by the laminate; and (ii) the laminate has a plurality of concentric layers including:

(a) an inner layer of a corrosion protective material substantially along and surrounding the length of the core substrate, (b) a layer of a first protective plastic coating surrounding the corrosion protective material, (c) a layer of a heat-resistive intumescent coating surrounding the first protective plastic coating, and a layer of a reinforcing mesh embedded in the layer of intumescent coating, and (d) an outer layer of a second protective plastic coating surrounding the layer of intumescent coating.

* * * * *